US005821534A

United States Patent [19]

Park

[11] Patent Number: 5,821,534

[45] Date of Patent: Oct. 13, 1998

[54] DEFLECTION BASED DAUGHTER ION SELECTOR

[75] Inventor: Melvin Park, Nashua, N.H.

[73] Assignee: Bruker Analytical Instruments, Inc., Billerica, Mass.

[21] Appl. No.: 561,635

[22] Filed: Nov. 22, 1995

[51] Int. Cl.[6] ..... H01J 49/40; H01J 49/28

[52] U.S. Cl. ..... 250/287; 250/294; 250/305; 250/396 R

[58] Field of Search ..... 250/287, 294, 250/305, 396 R

[56] References Cited

U.S. PATENT DOCUMENTS 4,472,631 9/1984 Enke et al. ..... 250/281

4,962,308 10/1990 Bormans et al. ..... 250/396 R

*Primary Examiner*—Jack I. Berman

*Attorney, Agent, or Firm*—Ward & Olivo

[57] ABSTRACT

A method and apparatus for analyzing ions by determining times of flight including using a deflectron based daughter ion selector for selecting daughter ions. Parent ions generated in an ion source may fragment to form daughter ions. Daughter ions may further fragment to form grand daughter ions. By selecting a specific type of daughter ion from ions formed in the ion source, one may obtain a grand daughter ion spectrum. According to the present invention, a deflectron based daughter ion selector, in the form of two deflectron and a set of selection plates, is used as a daughter ion selector.

27 Claims, 11 Drawing Sheets

1047.43
1062.59
1029.73
932.67
2.53
a.i.
500
000
500
000
500
000
500
0
940
990
1040
m/z a.i.
30000
25000
20000
15000
10000
5000
0
100
200
300
400
500
600
700
800
900
1000
m/z
932.4
901.6
784.2
756.3
619.4
547.3
517.3
506.3
400.3
382.2
353.8
263.3
255.3
235.2
166.2
110.2
70.1
72.0
86.0

DEFLECTION BASED DAUGHTER ION SELECTOR

TECHNICAL FIELD

This invention relates generally to ion beam handling and more particularly to a means of deflecting and selecting ions in time-of-flight mass spectrometry.

BACKGROUND ART

This invention relates in general to ion beam handling in mass spectrometers and more particularly to ion deflection and selection in time-of-flight mass spectrometers (TOFMS). The apparatus and method of mass analysis described herein is an enhancement of the techniques that are referred to in the literature relating to mass spectrometry.

The analysis of ions by mass spectrometers is important, as mass spectrometers are instruments that are used to determine the chemical structures of molecules. In these instruments, molecules become positively or negatively charged in an ionization source and the masses of the resultant ions are determined in vacuum by a mass analyzer that measures their mass/charge (m/z) ratio. Mass analyzers come in a variety of types, including magnetic field (B), combined (double-focusing) electrical (E) and magnetic field (B), quadrupole (Q), ion cyclotron resonance (ICR), quadrupole ion storage trap, and time-of-flight (TOF) mass analyzers, which are of particular importance with respect to the invention disclosed herein. Each mass spectrometric method has a unique set of attributes. Thus, TOFMS is one mass spectrometric method that arose out of the evolution of the larger field of mass spectrometry.

The analysis of ions by TOFMS is, as the name suggests, based on the measurement of the flight times of ions from an initial position to a final position. Ions which have the same initial kinetic energy but different masses will separate when allowed to drift through a field free region.

Ions are conventionally extracted from an ion source in small packets. The ions acquire different velocities according to the mass-to-charge ratio of the ions. Lighter ions will arrive at a detector prior to high mass ions. Determining the time-of-flight of the ions across a propagation path permits the determination of the masses of different ions. The propagation path may be circular or helical, as in cyclotron resonance spectrometry, but typically linear propagation paths are used for TOFMS applications.

TOFMS is used to form a mass spectrum for ions contained in a sample of interest. Conventionally, the sample is divided into packets of ions that are launched along the propagation path using a pulse-and-wait approach. In releasing packets, one concern is that the lighter and faster ions of a trailing packet will pass the heavier and slower ions of a preceding packet. Using the traditional pulse-and-wait approach, the release of an ion packet as timed to ensure that the ions of a preceding packet reach the detector before any overlap can occur. Thus, the periods between packets is relatively long. If ions are being generated continuously, only a small percentage of the ions undergo detection. A significant amount of sample material is thereby wasted. The loss in efficiency and sensitivity can be reduced by storing ions that are generated between the launching of individual packets, but the storage approach carries some disadvantages.

Resolution is an important consideration in the design and operation of a mass spectrometer for ion analysis. The traditional pulse-and-wait approach in releasing packets of ions enables resolution of ions of different masses by separating the ions into discernible groups. However, other factors are also involved in determining the resolution of a mass spectrometry system. "Space resolution" is the ability of the system to resolve ions of different masses despite an initial spatial position distribution within an ion source from which the packets are extracted. Differences in starting position will affect the time required for traversing a propagation path. "Energy resolution" is the ability of the system to resolve ions of different mass despite an initial velocity distribution. Different starting velocities will affect the time required for traversing the propagation path.

In addition, two or more mass analyzers may be combined in a single instrument to form a tandem mass spectrometer (MS/MS, MS/MS/MS, etc.). The most common MS/MS instruments are four sector instruments (EBEB or BEEB), triple quadrupoles (QQQ), and hybrid instruments (EBQQ or BEQQ). The mass/charge ratio measured for a molecular ion is used to determine the molecular weight of a compound. In addition, molecular ions may dissociate at specific chemical bonds to form fragment ions. Mass/charge ratios of these fragment ions are used to elucidate the chemical structure of the molecule. Tandem mass spectrometers have a particular advantage for structural analysis in that the first mass analyzer (MS1) can be used to measure and select molecular ion from a mixture of molecules, while the second mass analyzer (MS2) can be used to record the structural fragments. In tandem instruments, a means is provided to induce fragmentation in the region between the two mass analyzers. The most common method employs a collision chamber filled with an inert gas, and is known as collision induced dissociation CID. Such collisions can be carried out at high (5–10 keV) or low (10–100 eV) kinetic energies, or may involve specific chemical (ion-molecule) reactions. Fragmentation may also be induced using laser beams (photodissociation), electron beams (electron induced dissociation), or through collisions with surfaces (surface induced dissociation). It is possible to perform such an analysis using a variety of types of mass analyzers including TOF mass analysis.

In a TOFMS instrument, molecular and fragment ions formed in the source are accelerated to a kinetic energy:

$$eV = \frac{1}{2} mv^2 \tag{1}$$

where e is the elemental charge, V is the potential across the source/accelerating region, m is the ion mass, and v is the ion velocity. These ions pass through a field-free drift region of length L with velocities given by equation 1. The time required for a particular ion to traverse the drift region is directly proportional to the square root of the mass/charge ratio:

$$t = L\sqrt{\frac{m}{2eV}} \tag{2}$$

Conversely, the mass/charge ratios of ions can be determined from their flight times according to the equation:

$$\frac{m}{e} = at^2 + b \tag{3}$$

where a and b are constants which can be determined experimentally from the flight times of two or more ions of known mass/charge ratios.

Generally, TOF mass spectrometers have limited mass resolution. This arises because there may be uncertainties in the time that the ions were formed (time distribution), in their location in the accelerating field at the time they were formed (spatial distribution), and in their initial kinetic energy distributions prior to acceleration (energy distribution).

The first commercially successful TOFMS was based on an instrument described by Wiley and McLaren in 1955 (Wiley, W. C.; McLaren, I. H., Rev. Sci. Instrumen. 26 1150 (1955)). That instrument utilized electron impact (EI) ionization (which is limited to volatile samples) and a method for spatial and energy focusing known as time-lag focusing. In brief, molecules are first ionized by a pulsed (1–5 microsecond) electron beam. Spatial focusing was accomplished using multiple-stage acceleration of the ions. In the first stage, a low voltage (−150 V) drawout pulse is applied to the source region that compensates for ions formed at different locations, while the second (and other) stages complete the acceleration of the ions to their final kinetic energy (−3 keV). A short time-delay (1–7 microseconds) between the ionization and drawout pulses compensates for different initial kinetic energies of the ions, and is designed to improve mass resolution. Because this method required a very fast (40 ns) rise time pulse in the source region, it was convenient to place the ion source at ground potential, while the drift region floats at −3 kV. The instrument was commercialized by Bendix Corporation as the model NA-2, and later by CVC Products (Rochester, N.Y.) as the model CVC-2000 mass spectrometer. The instrument has a practical mass range of 400 daltons and a mass resolution of 1/300, and is still commercially available.

There have been a number of variations on this instrument. Muga (TOFTEC, Gainsville) has described a velocity compaction technique for improving the mass resolution (Muga velocity compaction). Chatfield et al. (Chatfield FT-TOF) described a method for frequency modulation of gates placed at either end of the flight tube, and Fourier transformation to the time domain to obtain mass spectra. This method was designed to improve the duty cycle.

Cotter et al. (VanBreeman, R. B.: Snow, M.: Cotter, R. J., Int. J. Mass Spectrom. Ion Phys. 49 (198) 35.; Tabet, J. C.; Cotter, R. J., Anal. Chem. 56 (1984) 1662; Olthoff, J. K.; Lys, I.: Demirev, P.: Cotter, R. J., Anal. Instrumen. 16 (1987) 93, modified a CVC 2000 time-of-flight mass spectrometer for infrared laser desorption of involatile biomolecules, using a Tachisto (Needham, Mass.) model 215G pulsed carbon dioxide laser. This group also constructed a pulsed liquid secondary time-of-flight mass spectrometer (liquid SIMS-TOF) utilizing a pulsed (1–5 microsecond) beam of 5 keV cesium ions, a liquid sample matrix, a symmetric push/pull arrangement for pulsed ion extraction (Olthoff, J. K.; Cotter, R. J., Anal. Chem. 59 (1987) 999–1002.; Olthoff, J. K.; Cotter, R. J., Nucl. Instrum. Meth. Phys. Res. B-26 (1987) 566–570. In both of these instruments, the time delay range between ion formation and extraction was extended to 5–50 microseconds, and was used to permit metastable fragmentation of large molecules prior to extraction from the source. This in turn reveals more structural information in the mass spectra.

The plasma desorption technique introduced by Macfarlane and Torgerson in 1974 (Macfarlane, R. D.; Skowronski, R. P.; Torgerson, D. F., Biochem. Biophys. Res Commoun. 60 (1974) 616.) formed ions on a planar surface placed at a voltage of 20 kV. Since there are no spatial uncertainties, ions are accelerated promptly to their final kinetic energies toward a parallel, grounded extraction grid, and then travel through a grounded drift region. High voltages are used, since mass resolution is proportional to U o /;eV, where the initial kinetic energy, U O / is of the order of a few electron volts. Plasma desorption mass spectrometers have been constructed at Rockefeller (Chait, B. T.; Field, F. H., J. Amer. Chem. Soc. 106 (1984) 193), Orsay (LeBeyec, Y.; Della Negra, S.; Deprun, C.; Vigny, P.; Giont, Y. M., Rev. Phys. Appl 15 (1980) 1631), Paris (Viari, A.; Ballini, J. P.; Vigny, P.; Shire, D.; Dousset, P., Biomed. Environ. Mass Spectrom, 14 (1987) 83), Upsalla (Hakansson, P.; Sundqvist B., Radiat. Eff. 61 (1982) 179) and Darmstadt (Becker, O.; Furstenau, N.; Krueger, F. R.; Weiss, G.; Wein, K., Nucl. Instrum. Methods 139 (1976) 195). A plasma desorption time-of-flight mass spectrometer has been commercialized by BIO-ION Nordic (Upsalla, Sweden). Plasma desorption utilizes primary ion particles with kinetic energies in the MeV range to induce desorption/ionization. A similar instrument was constructed at Manitobe (Chain, B. T.; Standing, K. G., Int. J. Mass Spectrum. Ion Phys. 40 (1981) 185) using primary ions in the keV range, but has not been commercialized.

Matrix-assited laser desorption, introduced by Tanaka et al. (Tanaka, K.; Waki, H.; Ido, Y.; Akita, S.; Yoshida, Y.; Yoshica, T., Rapid Commun. Mass Spectrom. 2 (1988) 151) and by Karas and Hillenkamp (Karas, M.; Hillenkamp, F., Anal. Chem. 60 (1988) 2299) utilizes TOFMS to measure the molecular weights of proteins in excess of 100,000 daltons. An instrument constructed at Rockefeller (Beavis, R. C.; Chait, B. T., Rapid Commun. Mass Spectrom. 3 (1989) 233) has been commercialized by VESTEC (Houston, Tex.), and employs prompt two-stage extraction of ions to an energy of 30 kev.

Time-of-flight instruments with a constant extraction field have also been utilized with multi-photon ionization, using short pulse lasers.

The instruments described thus far are linear time-of-flights, that is: there is no additional focusing after the ions are accelerated and allowed to enter the drift region. Two approaches to additional energy focusing have been utilized: those which pass the ion beam through an electrostatic energy filter.

The reflectron (or ion mirror) was first described by Mamyrin (Mamyrin, B. A.; Karatajev. V. J.; Shmikk, D. V.; Zagulin, V. A., Sov. Phys., JETP 37 (1973) 45). At the end of the drift region, ions enter a retarding field from which they are reflected back through the drift region at a slight angle. Improved mass resolution results from the fact that ions with larger kinetic energies must penetrate the reflecting field more deeply before being turned around. These faster ions than catch up with the slower ions at the detector and are focused. Reflectrons were used on the laser microprobe instrument introduced by Hillenkamp et al. (Hillenkamp, F.; Kaufmann, R.; Nitsche, R.; Unsold, E., Appl. Phys. 8 (1975) 341) and commercialized by Leybold Hereaus as the LAMMA (LAser Microprobe Mass Analyzer). A similar instrument was also commercialized by Cambridge Instruments as the IA ( Laser Ionization Mass Analyzer). Benninghoven (Benninghoven reflectron) has described a SIMS (secondary ion mass spectrometer) instrument that also utilizes a reflectron, and is currently being commercialized by Leybold Hereaus. A reflecting SIMS instrument has also been constructed by Standing (Standing, K. G.; Beavis, R.; Bollbach, G.; Ens, W.; Lafortune, F.; Main, D.; Schueler, B.; Tang, X.; Westmore, J. B., Anal. Instrumen. 16 (1987) 173).

Lebeyec (Della-Negra, S.; Lebeyec, Y., in Ion Formation from Organic Solids IFOS III, ed. by A. Benninghoven, pp 42–45, Springer-Verlag, Berlin (1986)) described a coaxial reflectron time-of-flight that reflects ions along the same path in the drift tube as the incoming ions, and records their arrival times on a channelplate detector with a centered hole that allows passage of the initial (unreflected) beam. This geometry was also utilized by Tanaka et al. (Tanaka, K.; Waki, H.; Ido, Y.; Akita, S.; Yoshida, T., Rapid Comun. Mass Spectrom. 2 (1988) 151) for matrix assisted laser desorption. Schlag et al. (Grotemeyer, J.; Schlag, E. W., Org. Mass Spectrom. 22 (1987) 758) have used a reflectron on a two-laser instrument. The first laser is used to ablate solid samples, while the second laser forms ions by multiphoton ionization. This instrument is currently available from Bruker. Wollnik et al. (Grix., R.; Kutscher, R.; Li, G.; Gruner, U.; Wollnik, H., Rapid Commun. Mass Spectrom. 2 (1988) 83) have described the use of reflectrons in combination with pulsed ion extraction, and achieved mass resolutions as high as 20,000 for small ions produced by electron impact ionization.

An alternative to reflectrons is the passage of ions through an electrostatic energy filter, similar to that used in double-focusing sector instruments. This approach was first described by Poschenroeder (Poschenroeder, W., Int. J. Mass Spectrom. Ion Phys. 6 (1971) 413). Sakurai et al. (Sakuri, T.; Fujita, Y; Matsuo, T.; Matsuda, H; Katakuse, I., Int. J. Mass Spectrom. Ion Processes 66 (1985) 283) have developed a time-of-flight instrument employing four electrostatic energy analyzers (ESA) in the time-of-flight path. At Michigan State, an instrument known as the ETOF was described that utilizes a standard ESA in the TOF analyzer (Michigan ETOF).

Lebeyec et al. (Della-Negra, S.; Lebeyec, Y., in Ion Formation from Organic Solids IFOS III, ed. by A. Benninghoven, pp 42–45, Springer-Verlag, Berlin (1986)) have described a technique known as correlated reflex spectra, which can provide information on the fragment ion arising from a selected molecular ion. In this technique, the neutral species arising from fragmentation in the flight tube are recorded by a detector behind the reflectron at the same flight time as their parent masses. Reflected ions are registered only when a neutral species is recorded within a preselected time window. Thus, the resultant spectra provide fragment ion (structural) information for a particular molecular ion. This technique has also been utilized by Standing (Standing, K. G.; Beavis, R.; Bollbach, G.; Ens, W.; Lafortune, F.; Main, D.; Schueler, B.; Tang, X.; Westmore, J. B., Anal. Instrumen. 16 (1987) 173).

Although TOF mass spectrometers do not scan the mass range, but record ions of all masses following each ionization event, this mode of operation has some analogy with the linked scans obtained on double-focusing sector instruments. In both instruments, MS/MS information is obtained at the expense of high resolution. In addition correlated reflex spectra can be obtained only on instruments which record single ions on each TOF cycle, and are therefore not compatible with methods (such as laser desorption) which produce high ion currents following each laser pulse.

New ionization techniques, such as plasma desorption (Macfarlane, R. D.; Skowronski, R. P.; Torgerson, D. F.; Biochem. Bios. Res. Commun. 60 (1974) 616), laser desorption (VanBreemen, R. B.; Snow, M.; Cotter, R. J., Int. J. Mass Spectrom. Ion Phys. 49 (1983) 35; Van der Peyl, G. J. Q.; Isa, K.; Haverkamp, J.; Kistemaker, P. G., Org. Mass Spectrom. 16 (1981) 416), fast atom bombardment (Barber, M.; Bordoli, R. S.; Sedwick, R. D.; Tyler, A. N., J. Chem. Soc., Chem. Commun. (1981) 325–326) and electrospray (Meng, C. K.; Mann, M.; Fenn, J. B., Z. Phys. D10 (1988) 361), have made it possible to examine the chemical structures of proteins and peptides, glycopeptides, glycolipids and other biological compounds without chemical derivatization. The molecular weights of intact proteins can be determined using matrix assisted laser desorption ionization (MALDI) on a TOF mass spectrometer or electrospray ionization. For more detailed structural analysis, proteins are generally cleaved chemically using CNBr or enzymatically using trypsinor other proteases. The resultant fragments, depending upon size, can be mapped using MALDI, plasma desorption or fast atom bombardment. In this case, the mixture of peptide fragments (digest) is examined directly resulting in a mass spectrum with a collection of molecular ion corresponding to the masses of each of the peptides. Finally, the amino acid sequences of the individual peptides which make up the whole protein can be determined by fractionation of the digest, followed by mass spectral analysis of each peptide to observe fragment ions that correspond to its sequence.

It is the sequencing of peptides for which tandem mass spectrometry has its major advantages. Generally, most of the new ionization techniques are successful in producing intact molecular ions, but not in producing fragmentation. In the tandem instrument the first mass analyzer passes "parent ions" (i.e. molecular ions) corresponding to the peptide of interest. These ions are activated toward fragmentation in a collision chamber, and their fragmentation products (daughter ions) extracted and focused into the second mass analyzer which records a daughter ion (or fragment ion) spectrum.

A tandem TOFMS consists of two TOF analysis regions with an ion gate between the two regions. As in conventional TOFMS, ions of increasing mass have decreasing velocities and increasing flight times. Thus, the arrival time of parent ions at the ion gate at the end of the first TOF analysis region is dependent on the mass-to-charge ratio of the parent ions. If one opens the ion gate only at the arrival time of the parent ion mass of interest, then only ions of that mass-to-charge will be passed into the second TOF analysis region.

However, it should be noted that the products of a parent ion dissociation that occurs after the acceleration of the parent ion to its final potential will have the same velocity as the original parent ion. A daughter ion will therefore arrive at the ion gate at the same time as the parent ion from which it was formed and will be passed by the gate (or not) just as the parent ion would have been.

The arrival times of daughter ions at the end of the second TOF analysis region is dependent on the daughter ion mass because a reflectron is used. As stated above, daughter ions have the same velocity as the parent ions from which they originate. As a result, the kinetic energy of a daughter ion is directly proportional to the daughter ion mass. Because the flight time of an ion through a reflectron is dependent on the kinetic energy of the ion, and the kinetic energy of the daughter ions are dependent on their masses, the flight time of the daughter ions through the reflectron is dependent on their masses.

As described thus far, tandem mass spectrometers have two mass analysis stages—a first mass analysis stage which mass analyzes and selects a parent ion and a second stage which mass analyzes daughter ions formed by the dissociation of the parent ions. However, it is possible to have a third (or more) mass analysis stage in a tandem mass spectrometer. By adding a third mass analysis stage, one may select a parent ion of interest, and a daughter ion of interest which is formed from that parent ion, and then analyze the products of the daughter ion dissociation to form a grand daughter spectrum. Grand daughter spectra can provide information about the structure of the analyte molecules not provided by daughter ion spectra.

The deflectron based daughter ion selector represents an additional mass analysis stage which may readily be added to an existing TOF mass spectrometer.

SUMMARY OF THE INVENTION

In TOF mass spectrometry, ions are analyzed and selected based on their velocity. That is, based on the time for the ions to travel from one point in the spectrometer to another. The deflectron based daughter ion selector, however, selects ions on the basis of their kinetic energy. According to the present invention, ions are formed in the ion source all with the same kinetic energy. Daughter ions produced by parent ion fragmentation once the parent ions have left the source will have virtually the same velocity as the parent ions from which they were formed. As a result, the kinetic energy of the daughter ions will be a fraction of that of their parent ions which is equal to the mass of the daughter ion divided by the mass of the parent ion.

A deflectron according to the present invention consists of two parallel conducting planar electrodes. The deflectron is placed in the spectrometer such that the ions being analyzed must pass through the electrodes. When the geometry of the electrodes is properly adjusted, a potential difference between the electrodes will cause ions passing through the deflectron to be deflected. The angle by which an ion is deflected is related to its kinetic energy.

The daughter ion selector according to the present invention contains a deflectron which deflects the daughter ions according to their kinetic energies, and therefore their masses. Following this deflectron is a physical restriction with which ions are selected according to the angle by which they have been deflected. A second deflectron is placed after the physical restriction so as to deflect the selected daughter ions back to an appropriate trajectory for further TOF mass analysis.

The invention is a specific design for a tandem TOF mass spectrometer incorporating two TOF mass analyzers. This instrument also incorporates Einsel lens focusing, an ion gate, and a patented (U.S. Pat. No. 4,731,532) two stage gridless reflectron.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

DETAILED DESCRIPTION OF THE PREFERRED EMBODIMENT

Figure 1:
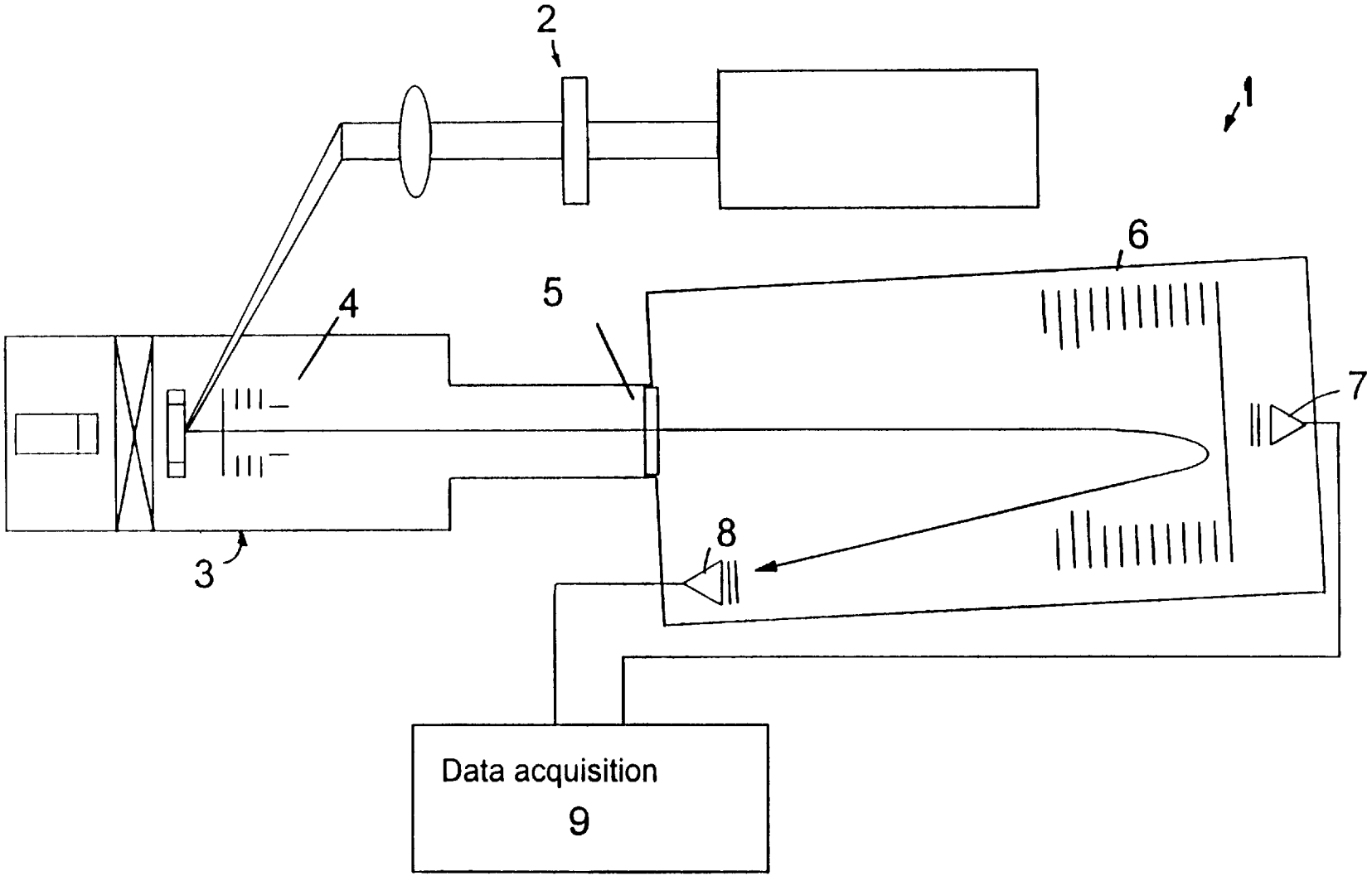
FIG. 1 is a schematic view of prior art commonly referred to as a REFLEX spectrometer.

With respect to FIG. 1, prior art TOFMS 1 is shown, with a laser system 2, ion source 3, deflector 4, ion gate 5, reflectron 6, linear detector 7, reflector detector 8 and a data acquisition unit 9. In FIG. 1, a pulse of radiation from laser system 2 generates a packet of ions from a solid sample. The ion packet is accelerated through, and out of, the ion source 3 by an electrostatic field. During the ion generation and acceleration, the ions may coincidentally be activated toward fragmentation. During the analysis, the ions of the original packet separate from one another according to their masses as given by equations 2 and 3. Some unwanted ions can be removed from the analysis using the deflector 4. The remaining ions drift through the spectrometer until arriving at ion gate 5. Activated ions may fragment at a random position between source 3 and ion gate 5. However, daughter ions will arrive at ion gate 5 simultaneously with their parent ions. At ion gate 5, a parent ion mass of interest can be selected. Selected parent ions and daughter ions formed from these parent ions may drift through the spectrometer until they arrive at the linear detector 7. Alternatively, the reflectron 6 may be used to reflect the ions so that they travel to the reflector detector 8. The mass and abundance of the parent and daughter ions is measured via the data acquisition system 9 as the flight time of the ions from the source 3 to one of the detectors 7 or 8 and the signal intensity at the detectors respectively.

Figure 2:
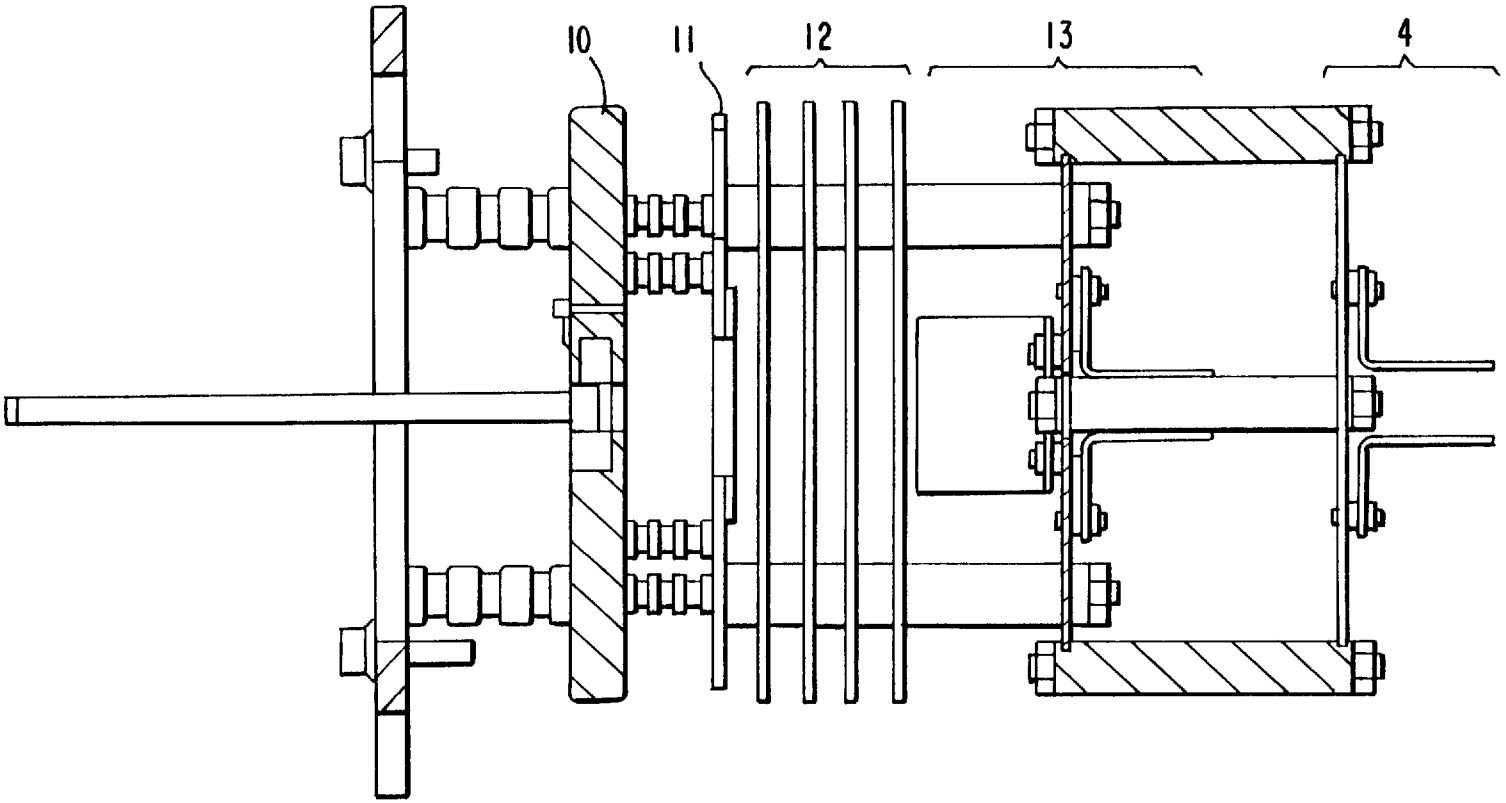
FIG. 2 is a diagram of an ion source, as used with the present invention.

With respect to FIG. 2, a diagram of an ion source 3 as used with the present invention is shown. Ions are generated by laser desorption from the surface of the sample plate 10 which is biased to a high voltage (e.g. 20 kV). Ions are accelerated by an electrostatic field toward the extraction plate 11 which is held at ground potential. Ions are focused by the electrostatic lens system 12, and steered in two dimensions by the steering plates 13. Finally, some types of unwanted ions are removed from the ion beam by deflector 4.

Figure 3:
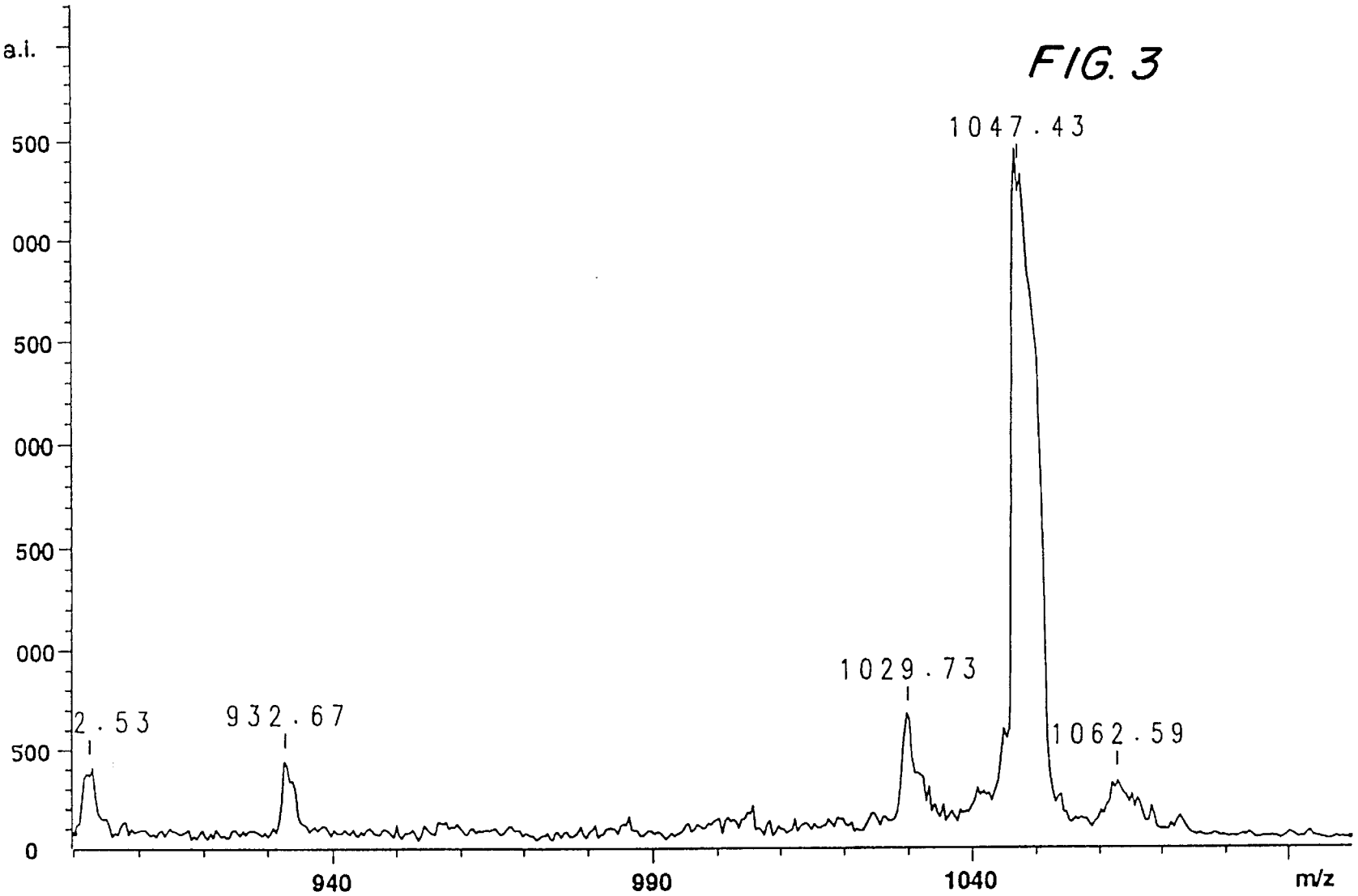
FIG. 3 is a graph of the mass spectrum of angiotensin II showing the molecular ion at mass 1047 amu, using a prior art TOF system.

With respect to FIG. 3, a graph of the mass spectrum of angiotensin II showing the molecular ion at mass 1047 amu, using a prior art TOF system (Reflex) is shown. This spectrum was recorded using ion gate 5 to select mass 1047 parent ion, reflectron 6 and detector 8. Because the flight time of daughter ions through reflectron 6 is a function of daughter ion mass, it is possible to observe some daughter ions at apparent masses 902, 933, and 1030 amu.

Figure 4:
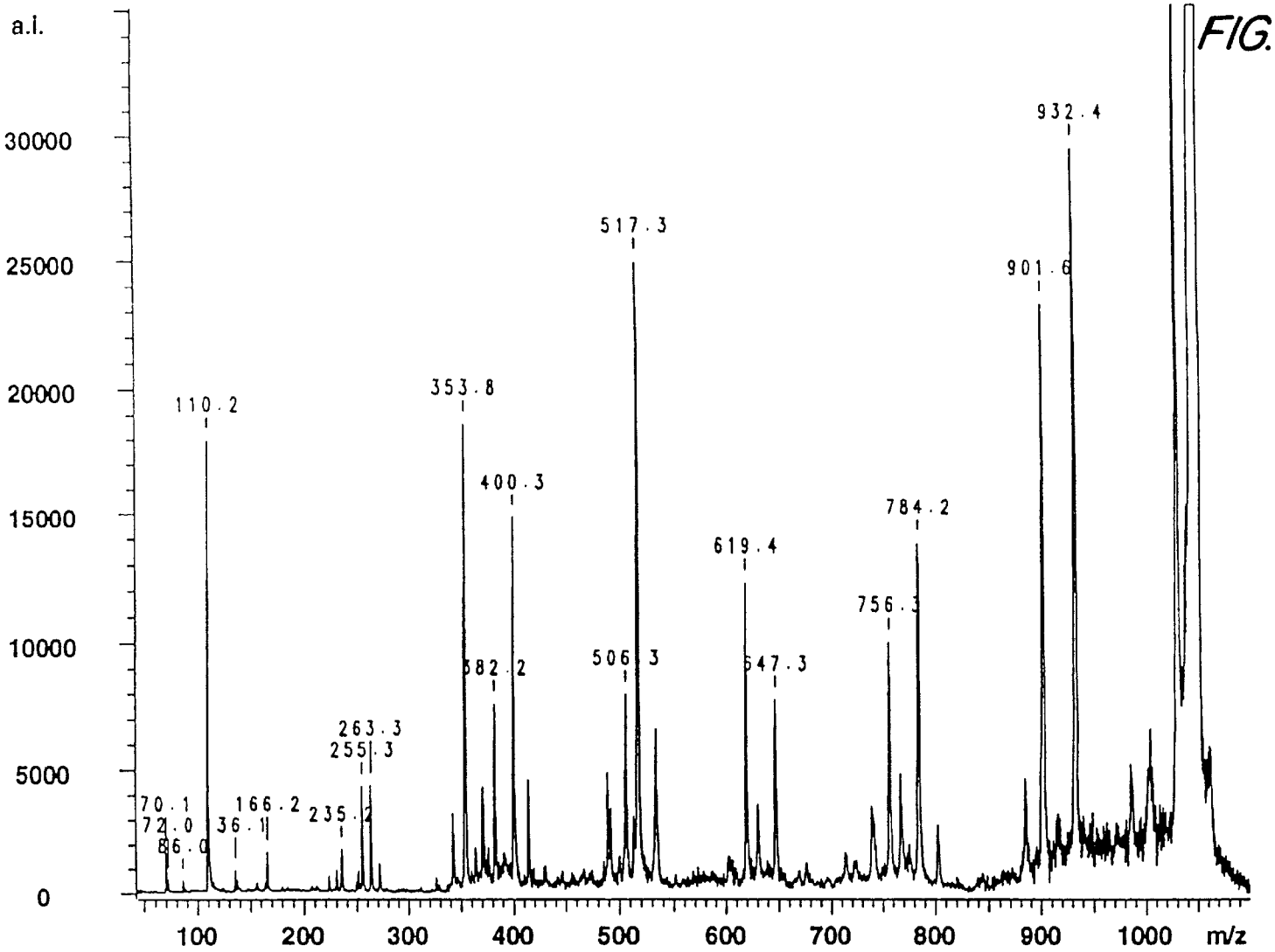
FIG. 4 is a graph of a daughter ion spectrum of angiotensin II, obtained using a prior art tandem TOF mass spectrometer.

With respect to FIG. 4, a graph of a daughter ion spectrum of angiotensin II, produced using the ion gate as described above is shown. The mass of the daughter ions are determined via their flight time from source 2 to detector 8. When a single stage reflectron is used, the relationship between parent ion mass, daughter ion mass, and total daughter ion flight time is given by:

$$t = (L_1 + L_3)\sqrt{\frac{M}{2qV_1}} + \frac{2mL_2}{qV_2}\sqrt{\frac{2qV_1}{M}} \quad (4)$$

where $L_1$ is the distance from the source to the reflectron, $L_2$ is the length of the reflectron, $L_3$ is the distance from the reflectron to the detector, $V_1$ is the source potential, $V_2$ is the reflectron potential, M is the parent ion mass, m is the daughter ion mass, and q is the elemental charge. A similar relationship holds when a two stage reflector, such as that of the prior art Reflex TOF mass spectrometer, is used. Using such an equation, it is possible to calibrate a spectrum like that of FIG. 4 and thereby assign masses to the ions represented.

As in FIG. 4, it is often the case that many different types of daughter ions can be formed from a single type of parent ion. In general, mass spectra become more difficult to interpret as the number of types of ions represented in the spectrum increases. This can be particularly troublesome in the analysis of large molecules such as peptide. To overcome this difficulty, one might select daughter ions of interest and use them to produce grand daughter ion spectra. In essence, the grand daughter ion spectra show the relationship between the various daughter ions. In this way, one can more readily determine the structure of the substance being analyzed.

Figure 5:
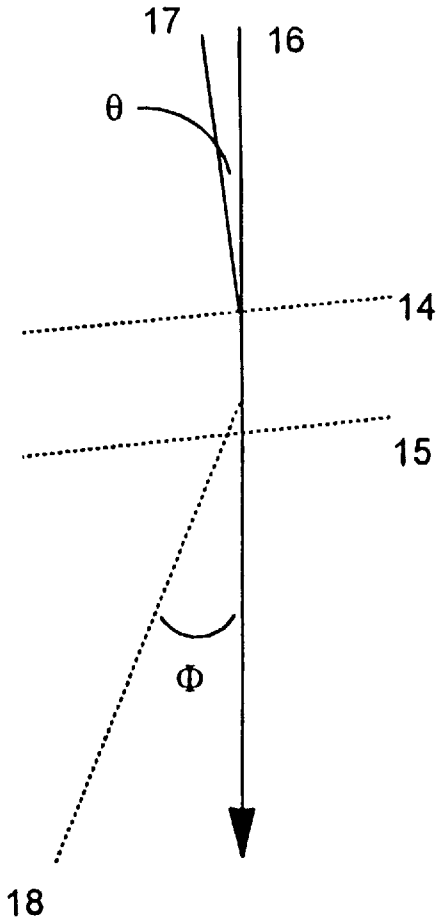
FIG. 5 is a depiction of an ion trajectory through a deflectron according to the present invention.

FIG. 5 is a depiction of a deflectron as used in the present invention and an example ion path through the deflectron. The deflectron consists of two fine mesh metal grids 14 and 15 placed adjacent and parallel to one another. Grids 14 and 15 may be, for example, nickel, 70 lines per inch, 90% transmission mesh. The normal of the plane in which the grids lie, 17, is at some angle, θ, from direction of motion 16. A potential, $V_1$, is applied to grid 14, and a second potential, $V_2$, is applied to grid 15 so that ions pass through this potential change when travelling along paths 16 and 18. Ions travelling along path 16 have a given kinetic energy, $E_f$, before passing grid 14. If the potential difference, $V=V_2-V_1$, between grids 14 and 15 is zero, then ions can continue along path 16 unperturbed. However, assuming the ions are positively charged and V>0 then the ions will be deflected by some angle, Φ, given by:

$$\phi = \sin^{-1}\sqrt{\frac{E_f \sin^2(\theta)}{E_f - qV}} - \theta \quad (5)$$

onto some other path (e.g. path 18).

Figure 6A:
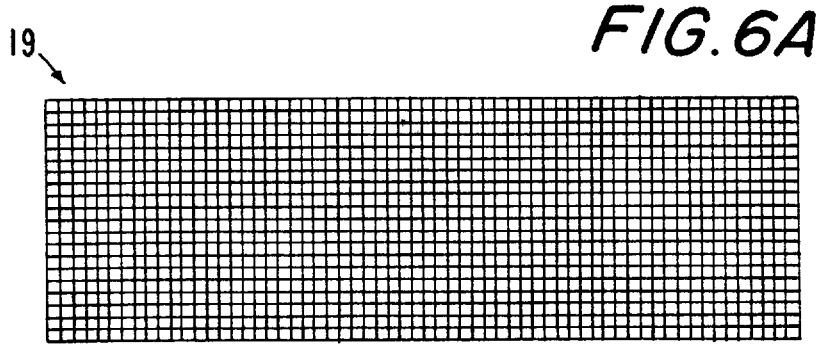
FIG. 6A is a depiction of a selection plate which is used in the deflectron based daughter ion selector according to the present invention.
Figure 6B:
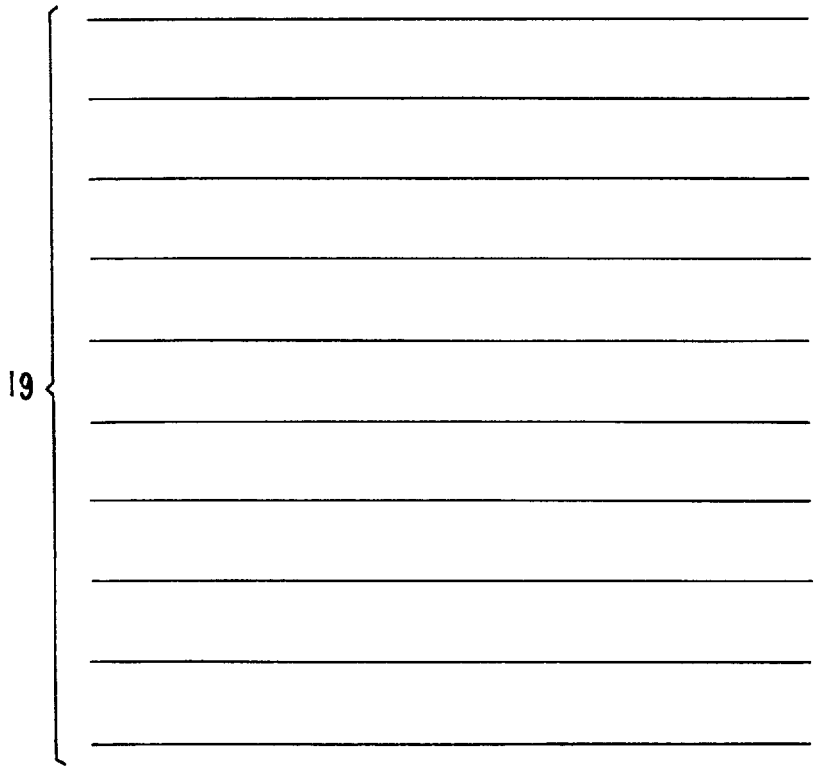
FIG. 6B is a depiction of how the selection plates are assembled into an array which is used in the deflectron based daughter ion selector according to the present invention.

The deflected ions can be filtered according to the angles by which they have been deflected. To accomplish this, an array of selection plates are used in the deflectron based daughter ion selector according to the present invention. FIGS. 6A and 6B depict a single selection plate and an array of selection plates respectively. The dimensions of the selection plates and the selection plate array may vary according to the desired performance of the daughter ion selector, however, the selection plate of FIG. 6A might typically have dimensions of 10 mm×30 mm. In any case, the selection plate should be thin. For example, if made of steel the selection plate may be as thin as 0.1 mm.

As shown in FIG. 6B the selection plates are assembled into an array by placing many selection plates adjacent and parallel to one another. As many selection plates are used as necessary to cover the range of expected ion paths. That is, if the ion "beam" is 10 mm in diameter, then enough selection plates are used to make the selector at least 10 mm wide. The distance between adjacent plates is a small constant distance (e.g. 3 mm).

Figure 7:
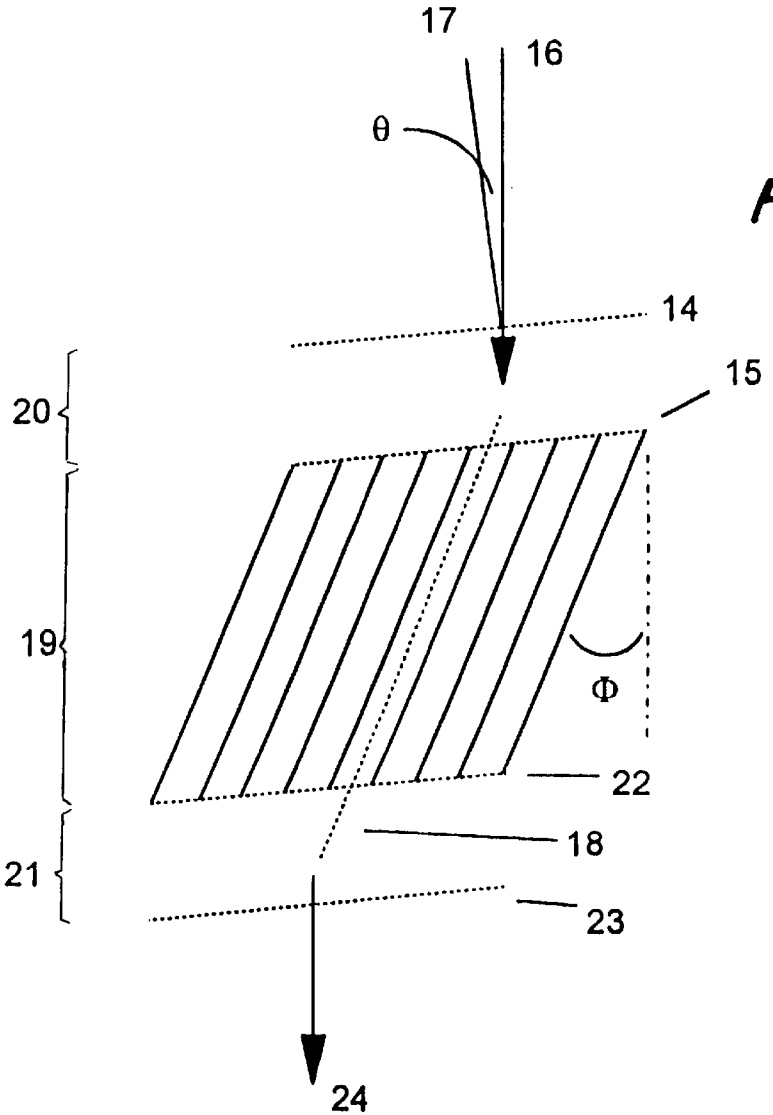
FIG. 7 is a depiction of a deflectron based daughter ion selector according to the present invention and an example ion path through the device.

The array of selection plates is assembled into the deflectron based daughter ion selector as shown in FIG. 7. FIG. 7 depicts a deflectron based daughter ion selector including deflectrons 20 and 21, and selection plate array 19. Ions enter deflectron 20 and are deflected according to equation 5 and as discussed regarding FIG. 5. Selection plate array 19 is held at the same potential as grid 15 of deflectron 20 and grid 22 of deflectron 21. Also, the selection plate array is tilted at angle Φ with respect to the original direction of motion of the ions as shown in FIG. 7. Therefore, ions entering the deflectron based daughter ion selector with kinetic energy $E_f$, will be deflected by angle Φ and then drift through selection plate array 19 without colliding with the selection plates. Other ions having other initial kinetic energies will be deflected by a different angle and therefore will collide with the selection plates and thereby be eliminated. Ions of the correct initial kinetic energy will drift along example path 18 until arriving at deflectron 21. If grid 23 is at the same potential as grid 14 then deflectron 21 can deflect the selected ions to example trajectory 24 which is parallel to their original direction of motion on example path 16.

Figure 8:
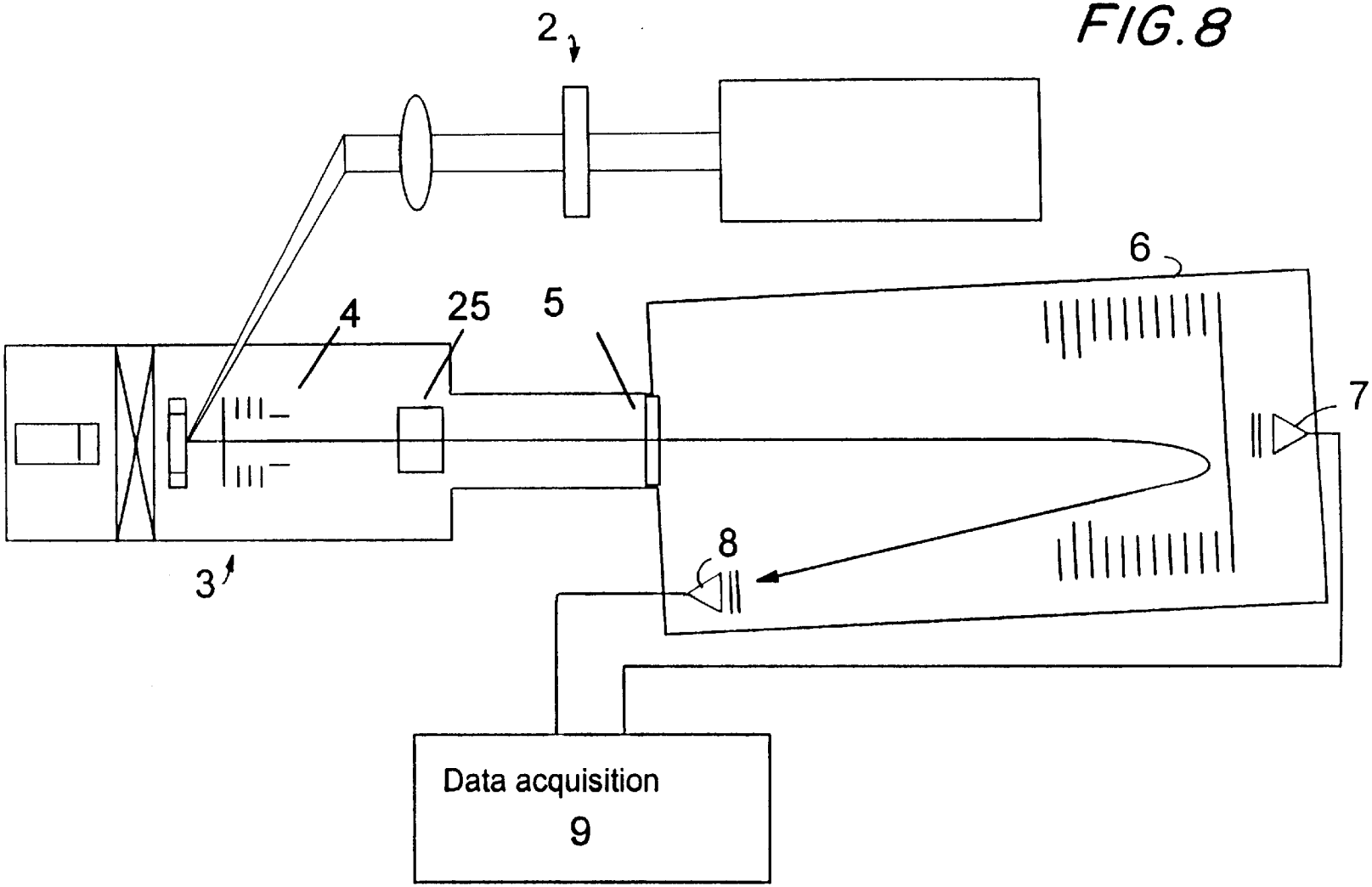
FIG. 8 is a diagram of the REFLEX spectrometer including the deflectron based daughter ion selector according to the present invention.

FIG. 8 depicts the TOF mass spectrometer of FIG. 1 including deflectron based daughter ion selector 25 of the present invention. As depicted in FIG. 8, after leaving the ion source, ions first encounter daughter ion selector 25 and then ion gate 5. As discussed above daughter ions have the same velocity as their parent ions. As a result, the kinetic energy of daughter ions, $E_f$, is a fraction of that of their parent ions:

$$E_f = \left(\frac{m_f}{m_o}\right) E_o \quad (6)$$

where $m_f$ is the daughter ion mass, $m_o$ is the parent ion mass, and $E_o$ is the parent ion kinetic energy. Daughter ions of the proper kinetic energy are allowed to pass through daughter ion selector 25 in accordance with equation 5 regardless of the mass of the parent ions from which they originate. The parent ion type is selected at ion gate 5. Even though the parent ions themselves may no not appear at ion gate 5, the daughter ions selected at daughter ion selector 25 have the same velocity as the parent ions from which they originate. Therefore, the daughter ions will arrive at the ion gate at the same time their parent ions would have. Thus, the daughter ions are selected at selector 25 on the basis of the ratio of their masses relative to that of their parent ions and at ion gate 5 based on the parent ions from which they originate. In this way both the parent ion and daughter ion masses are determined.

Note from equation 5 that it is possible to select a given daughter ion via several adjustable variables—i.e. ϕ, θ, V, and $E_o$. It is desirable, for various reasons, that $E_o$ remain at a set value. In order to have a high mass resolution in the selection of high mass (i.e.>1000 amu) ions, the angle θ should be maintained at a small and fixed value. While θ could be varied as a function of the desired daughter ion mass, it is much more convenient to use ϕ and V to select the daughter ions.

If θ is maintained at a small (~10°) and constant angle, then ϕ can be used to set the mass resolution of the selector and V can be used to set the daughter ion mass. The mass resolution of the selector as discussed here is $m_f$/dm where dm is the mass difference between the highest and lowest mass ion which can pass through the selector with 50% efficiency when $m_f$ is selected. The mass resolution of the selector is related to the length of the selection plates, the distance between adjacent selection plates, and the angle Φ.

Mass resolution improves with increasing selection plate length and increasing angle Φ but worsens with increasing distance between adjacent selection plates.

Figure 9:
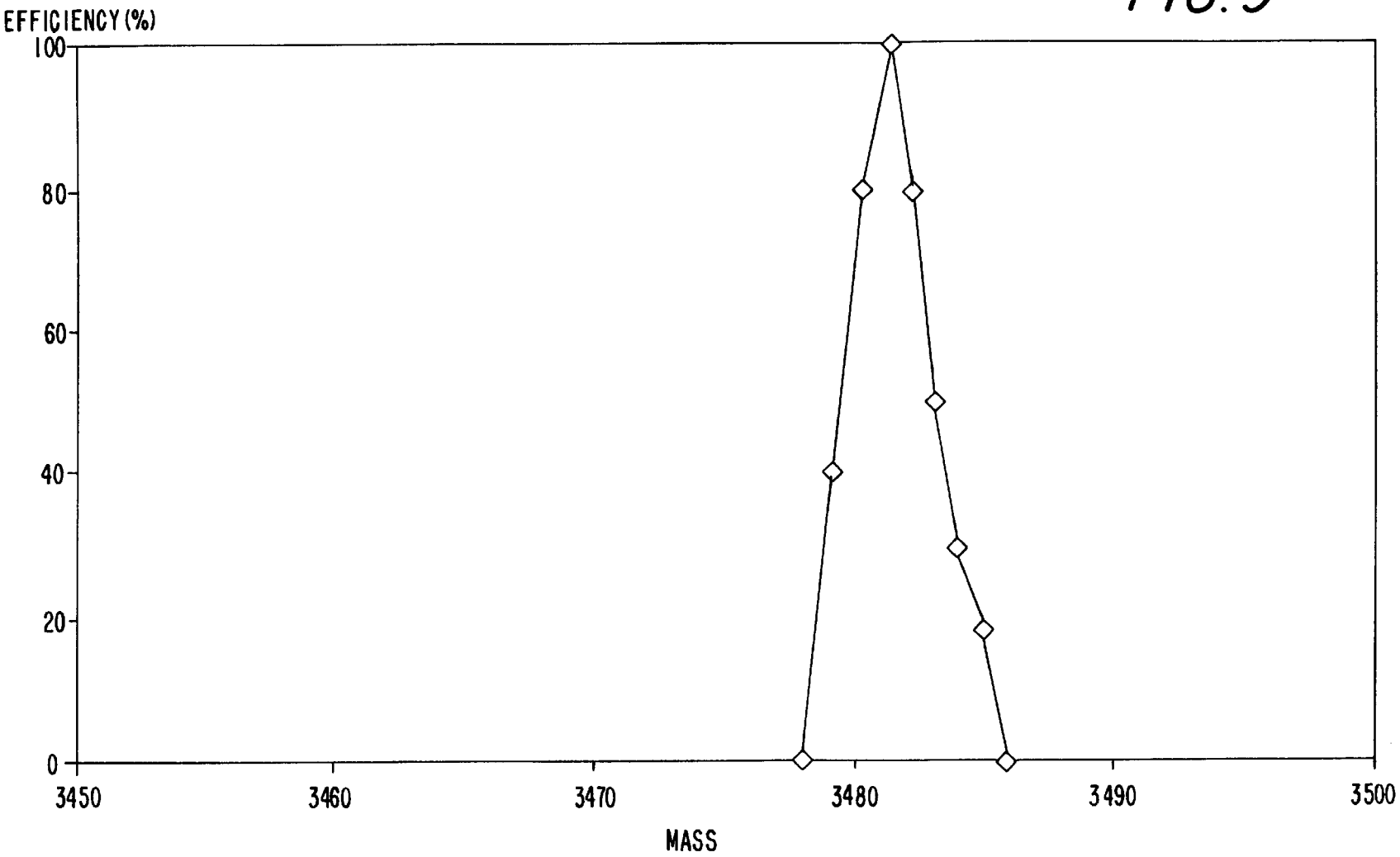
FIG. 9 is a plot of the ion transmission efficiency through the deflectron based daughter ion selector according to the present invention as a function of mass under a given set of conditions.

The prediction of the mass resolution of the selector is non-trivial and was calculated using numerical methods. Considering a case where $m_o$ is 4000 amu, $E_o$ is 28.5 keV, and the kinetic energy released by the fragmentation of the parent ion is 5 eV, it can readily be shown that the mass resolution at mass 3500 can be well over 800. The predicted transmission efficiency under these conditions is plotted in FIG. 9 as a function of ion mass. Such resolution is typically sufficient to select a single type of daughter ion from the daughter ions produced by a given type of parent ion (see FIG. 4).

Note that in the preferred embodiment, both the angle, ϕ, and voltage, V, on the selector should be adjustable. In such a case, the influence of the selector on the ion beam can be removed—so that a conventional spectrum can be obtained—by setting V to 0V and ϕ to 0°. So, a parent ion spectrum can be obtained by deactivating both selector 25 and ion gate 5. A daughter ion spectrum can be obtained by using ion gate 5 to select a parent ion but deactivating selector 25 so that all daughter ions of the selected parent ion can be detected. And a grand daughter ion spectrum can be obtained by using ion gate 5 to select a parent ion and selector 25 to select a daughter ion. Fragmentation of the selected daughter ions produces grand daughter ions which are mass analyzed and recorded in a spectrum similar to that shown in FIG. 4.

Figure 10:
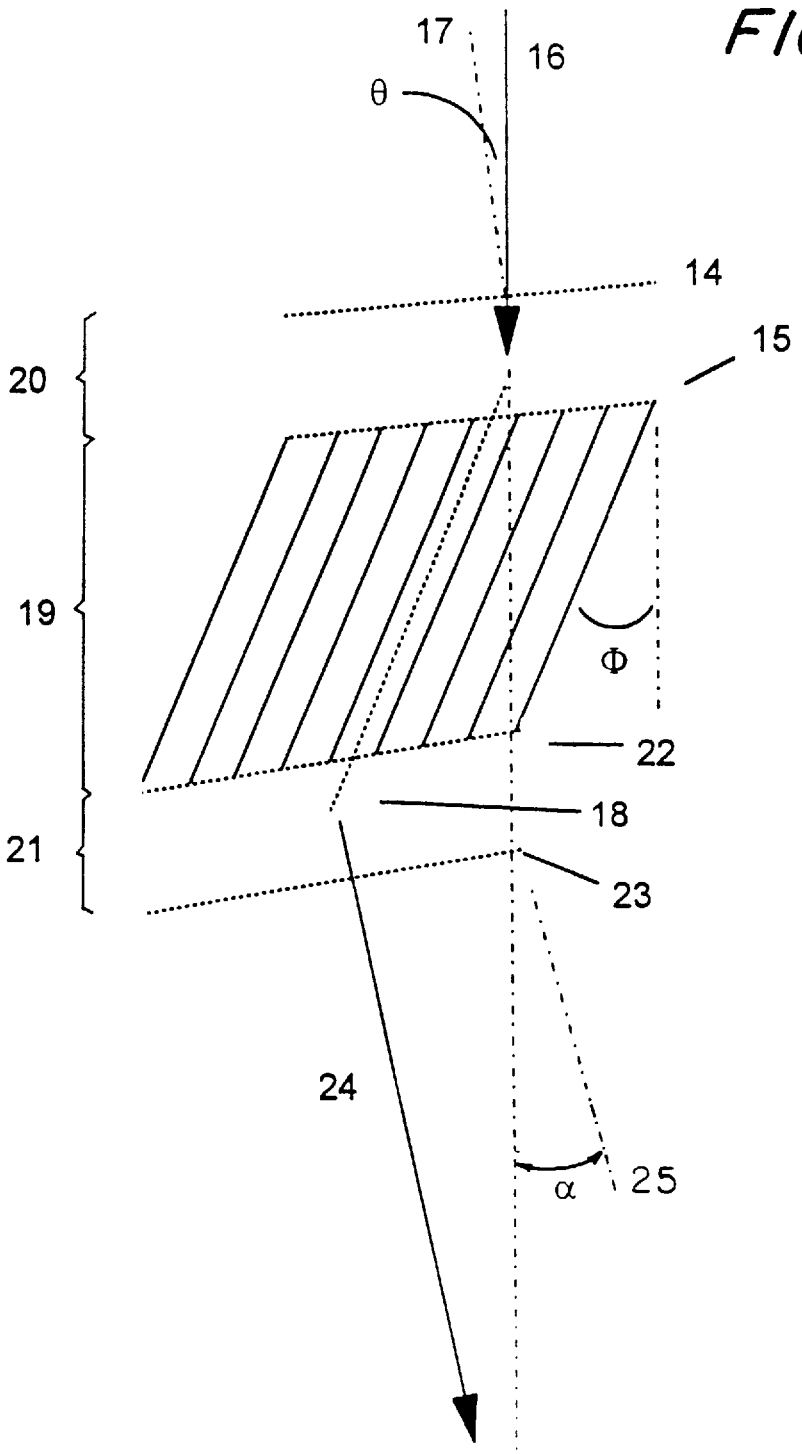
FIG. 10 is an alternate embodiment of a deflectron based daughter ion selector in which the angle of placement of the second deflectron is different than that of the first deflectron.

As mentioned above, once the ions are past selection plates 19, they are accelerated back to their original velocity by deflectron 21. In the simplest version of the daughter ion selector, the second deflectron would be tilted to the same angle θ as the first deflectron and the potential on grid 23 would be the same as that on grid 14. While the velocity of the ions would be the same after the selector as before, they would be offset by some distance in the direction in which they were first deflected. As depicted in FIG. 10 it may in some cases be desirable to tilt deflectron 21 to a slightly greater angle, α between the normal of the deflectron 25 and the original direction of ion motion 16 to correct for this offset. The effect of this is that the ions are turned slightly from their original direction of motion so that they eventually arrive at some point—i.e. a detector—which their original trajectory would have carried them to. Alternatively, the potential on grid 23 may be set to some potential other than that on grid 14 such that the ions follow path 24 even though angles α and θ are equivalent.

Figure 11:
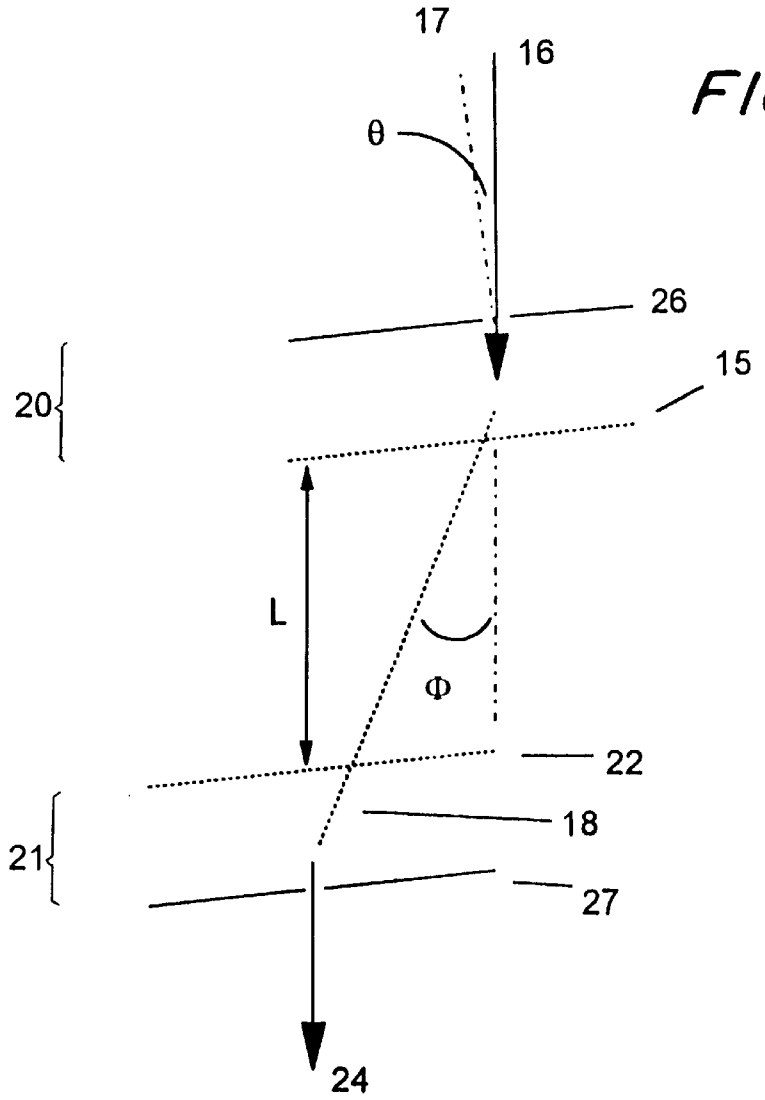
FIG. 11 is another alternate embodiment of a deflectron based daughter ion selector in which plates with holes or slits are used instead of grids.

A second alternative to the preferred embodiment of FIG. 7 is depicted in FIG. 11. The embodiment of FIG. 11 employs solid metal plates 26 and 27 instead of grids 14 and 23 respectively. The plates 26 and 27 have apertures or slits through which ions may pass. Also, the embodiment of FIG. 11 has no selection plates. Ions on path 16 enter the selector through an aperture or slit in plate 26 and are deflected by deflectron 20. The aperture or slit of plate 27 is positioned in such a way that only ions that have been deflected by the proper angle, Φ, onto paths 18 and then 24 will pass through the opening on plate 27. Other ions will collide with plate 27 and thereby be eliminated.

Note that the embodiment of FIG. 11 assumes a very well defined ion path. In contrast, the preferred embodiment of FIG. 7 allows for ions to enter and exit the selector at a wide range of positions. That is, the ion "beam" used with the preferred embodiment may have a large (e.g. ~10 mm) diameter whereas that used with the embodiment of FIG. 11 must have a small (e.g. ~2 mm) diameter.

While the foregoing embodiments of the invention have been set forth in considerable detail for the purposes of making a complete disclosure of the invention, it will be apparent to those of skill in the art that numerous changes may be made in such details without departing from the spirit and the principles of the invention.

I claim:

1. A deflectron for deflecting daughter ions, said deflectron comprising:

a first conductive electrode energized at a first potential;

a second conductive electrode, wherein said second conductive electrode is energized at a second potential, and wherein said second conductive electrode is aligned in parallel with respect to said first conductive electrode;

an ion beam pathway formed between said first and second conductive electrodes;

wherein ions propagated along said ion beam pathway are deflected as said ions travel through said pathway in response to a potential difference between said first and second potentials; and means for filtering said deflected ions according to the angles by which they have been deflected.

2. The deflectron according to claim 1 wherein said ions are deflected at angles not greater than 90 degrees from said ion beam pathway.

3. The deflectron according to claim 2 wherein said angles are less than 90 degrees.

4. The deflectron according to claim 1 wherein said electrodes are planar sheets.

5. The deflectron of claim 4 wherein said planar sheets are aligned in parallel.

6. The deflectron of claim 1 wherein said electrodes are grids.

7. The deflectron according to claim 6 wherein said grids are aligned in parallel.

8. The deflectron of claim 1 wherein said electrodes are metallic apertured plates.

9. The deflectron according to claim 8 wherein said metallic apertured plates are aligned in parallel.

10. A daughter ion selector comprising:

a deflectron for deflecting daughter ions according to kinetic energies associated with said daughter ions;

an ion beam restrictor wherein ions are selected according to an angle of ion reflection;

a second deflectron situated downstream from said ion beam restrictor to deflect selected daughter ions into a trajectory suitable for analysis.

11. The daughter ion selector according to claim 10 wherein said ions are deflected at angles not greater than 90 degrees from an ion beam pathway.

12. The daughter ion selector according to claim 11 wherein said angles are less than 90 degrees.

13. The daughter ion selector according to claim 10 wherein electrodes formed of planar sheets are used to deflect said ions.

14. The daughter ion selector of claim 13 wherein said planar sheets are aligned in parallel.

15. The daughter ion selector of claim 10 wherein said electrodes are grids.

16. The daughter ion selector according to claim 15 wherein said grids are aligned in parallel.

17. The daughter ion selector of claim 10 wherein said electrodes are metallic apertured plates.

18. The daughter ion selector according to claim 17 wherein said metallic apertured plates are aligned in parallel.

19. A method of mass selection in time of flight mass spectrometry comprising the use of:

a first deflectron consisting of:

a first conductive electrode energized at a first potential;

a second conductive electrode, wherein said second conductive electrode is energized at a second potential, and wherein said second conductive electrode is aligned in parallel with respect to said first conductive electrode;

an ion beam pathway formed between said first and second conductive electrodes;

an ion beam restrictor wherein ions are selected according to an anale of ion deflection; and a second deflectron situated downstream from said ion beam restrictor to deflect selected daughter ions into a trajectory suitable for analysis;

wherein ions propagated along said ion beam pathway are deflected as said ions travel through said pathway in response to a potential difference between said first and second potentials.

20. A method of mass selection in time of flight mass spectrometry according to claim 19 wherein said ions are deflected at angles not greater than 90 degrees from said ion beam pathway.

21. A method of mass selection in time of flight mass spectrometry according to claim 20 wherein said angles are less than 90 degrees.

22. A method of mass selection in time of flight mass spectrometry according to claim 19 wherein electrodes formed of planar sheets are used to deflect said ions.

23. A method of mass selection in time of flight mass spectrometry according to claim 22 wherein said planar sheets are alligned in parallel.

24. A method of mass selection in time of flight mass spectrometry according to claim 19 wherein said electrodes are grids.

25. A method of mass selection in time of flight mass spectrometry according to claim 24 wherein said grids are alligned in parallel.

26. A method of mass selection in time of flight mass spectrometry according to claim 19 wherein said electrodes are metallic apertured plates.

27. A method of mass selection in time of flight mass spectrometry according to claim 26 wherein said metallic apertured plates are alligned in parallel.

* * * * *